US005746574A

United States Patent [19]

Czachor et al.

[11] Patent Number: 5,746,574

[45] Date of Patent: May 5, 1998

[54] LOW PROFILE FLUID JOINT

[75] Inventors: Robert P. Czachor, Cincinnati; Robert E. Jones, Fairfield, both of Ohio

[73] Assignee: General Electric Company, Cincinnati, Ohio

[21] Appl. No.: 863,133

[22] Filed: May 27, 1997

[51] Int. Cl.[6] ..... F01D 5/14

[52] U.S. Cl. ..... 415/115; 415/142; 415/175; 415/176; 285/368

[58] Field of Search ..... 415/142, 214.1, 415/176, 175, 115; 285/179, 368, 363, 332

[56] References Cited

U.S. PATENT DOCUMENTS

| | | | |
|---|---|---|---|
| 2,866,522 | 12/1958 | Morley et al. | 184/6 |
| 3,312,448 | 4/1967 | Hull, Jr. et al. | 253/39 |
| 4,167,097 | 9/1979 | Wosika et al. | 60/39.31 |
| 4,183,207 | 1/1980 | Libertini | 60/39.08 |
| 4,793,770 | 12/1988 | Chonewald et al. | 415/190 |
| 4,972,671 | 11/1990 | Asselin et al. | 60/39.08 |
| 5,080,555 | 1/1992 | Kempinger | 415/142 |
| 5,160,251 | 11/1992 | Ciokajlo | 415/142 |
| 5,272,869 | 12/1993 | Dawson et al. | 60/39.31 |
| 5,316,346 | 5/1994 | Maurer | 285/23 |
| 5,374,086 | 12/1994 | Higgins | 285/111 |
| 5,393,108 | 2/1995 | Kerr | 285/368 |

*Primary Examiner*—Edward K. Look
*Assistant Examiner*—Richard S. Woo
*Attorney, Agent, or Firm*—Andrew C. Hess; Patrick R. Scanlon

[57] ABSTRACT

A low profile joint is provided for a strut tube extending radially through a strut extending between an outer casing and an inner hub in a gas turbine engine frame. The strut tube has a longitudinal axis and a closed distal end. A sideseat is spaced from the distal end and is disposed substantially perpendicularly to the longitudinal axis to define a flow orifice. A secondary tube has a ballnose at a distal end thereof disposed in abutting contact with the sideseat for channeling fluid therebetween. A fastener joins together the strut and secondary tubes in compression between the ballnose and sideseat to maintain sealed contact therebetween for channeling fluid between the strut and secondary tubes.

12 Claims, 8 Drawing Sheets

LOW PROFILE FLUID JOINT

BACKGROUND OF THE INVENTION

The present invention relates generally to gas turbine engines, and, more specifically, to frames therein.

A gas turbine engine includes one or more turbine rotors joined to one or more rotor disks from which extend radially outwardly therefrom a plurality of circumferentially spaced apart turbine rotor blades. During operation, the blades extract energy from hot combustion gases which are carried through the rotors for performing useful work, such as powering a fan or compressor of the engine joined to respective ones of the rotors. The rotors are mounted in suitable bearings, which in turn are supported in corresponding frames joined to the external casing of the engine.

A typical frame includes an annular outer casing disposed coaxially with an annular inner hub, with a plurality of circumferentially spaced apart hollow struts extending radially therebetween and suitably fixedly joined thereto. The struts are suitably sized to provide a rigid frame for carrying the bearings loads from the hub radially outwardly to the casing.

The struts, however, necessarily pass directly through the flowpath of the combustion or compressor gases and therefore must be specifically sized to minimize undesirable flow blockage thereof. The outer profile of a typical strut is therefore a symmetrical airfoil shape, which is generally an elongated oval profile with relatively thin leading and trailing edges. The chord axis of the strut is generally aligned with the centerline axis of the engine to present a minimum leading edge cross section around which the combustion gases flow. The lateral or circumferential sidewalls of the struts are relatively long in the axial direction for providing suitable structural rigidity for carrying the required loads between the hub and casing.

The frames also provide a convenient passageway for typical service lines or conduits which carry fluid between the internal and external portions of the engine radially through the gas flowpath. For example, typical service lines include oil supply, damper bearing supply, oil drain, scavenge, and sump pressurization or pressure balance air supply. Accordingly, the service lines typically carry pressurized air through the frame struts, fresh oil to the internal bearings typically supported by the frame, and returning scavenge oil back to the oil supply system.

Any pressure losses in the gas flow through the turbine frame necessarily decreases the overall efficiency of the engine. Accordingly, the aerodynamic flowpath necessarily limits the size of the struts both in their axial or chord direction, as well as in their tangential or thickness direction. Correspondingly, the internal passage in each strut is also limited and has a relatively thin elongated oval profile limiting the size of the service lines which may be positioned therethrough.

However, the lubrication system and secondary air systems in the engine require certain minimum size of the service lines for suitable air and oil flowrates. Smaller service lines create higher pressure losses, which may adversely affect acceptable operation of the oil and air systems. The service lines therefore, typically have oval profiles to maximize their flow capacity within the oval struts.

Since the service lines carry fluid through one or more of the frame struts, they necessarily require suitable joints therein for allowing assembly and disassembly thereof during original manufacture of the engine as well as during subsequent maintenance operation. Preferably, the service lines should readily install radially through the frame struts using simple mechanical flow joints or connections which may be readily disconnected when desired for service. This is in contrast to simply welding together the service lines after assembly which would require undesirable cutting thereof during disassembly, with subsequent rewelding which is not desirable.

Accordingly, service lines include mechanical joints such as those typically known as B-nut joints which include a spherical concave seat in the one fitting in one portion of the service line, and a spherical convex ballnose in another fitting on an adjacent portion of the service line. A threaded nut surrounds the ballnose and engages a complementary threaded collar around the seat, with tightening of the nut compressing the ballnose in its seat for effecting a fluid-type seal, while allowing ready disassembly thereof when desired.

The B-nut joint is necessarily larger in size than the nominal size of the service line for maintaining constant flowrate of the fluid without undesirable pressure losses. Furthermore, the typical service line carried through a frame strut has a flattened, elongated oval outer profile matching the internal oval profile of the strut. In this way, higher flowrate of fluid through the service line may be obtained, compared to a simple round tube, without adverse pressure losses. However, the B-nut joint therefore becomes even larger relative to the minimum thickness of the flattened service line in view of its enlarged round shape for corresponding flow capacity.

Furthermore, the radially inner B-nut joint typically also includes an integral mounting flange attached to the frame hub to support the service line, which further increases the size of the joint assembly.

Accordingly, it is typically impossible to preassemble either of the seat or ballnose of the typical B-nut joint to either ends of the strut service line prior to inserting the strut service line through the strut during assembly since those fittings would not pass through the narrow width of the strut internal passage.

To resolve this problem, the typical strut conduit is initially fabricated with a simple free end which allows the conduit to be inserted radially through the narrow strut during assembly, with subsequent post-installation welding of the corresponding larger joint fitting to the end of the conduit. In this way, the service line extensions which join to the outer and inner ends of the strut conduit may be attached using conventional B-nut joints for subsequent disassembly during maintenance as required. However, if the strut conduit must be removed from the frame, one of its end fittings must necessarily be removed by cutting, which is undesirable.

Accordingly, a low profile fluid joint for a strut service line is desired which allows insertion of the service line through the strut during assembly and ready mechanical connection to the adjoining service line portions, and disassembly thereof when desired, without the need for post-installation welding for assembly, or cutting the service line for disassembly. The low profile joint should have adequate flow capability for matching the flow capability of the service line itself.

SUMMARY OF THE INVENTION

A low profile joint is provided for a strut tube extending radially through a strut extending between an outer casing and an inner hub in a gas turbine engine frame. The strut tube has a longitudinal axis and a closed distal end. A sideseat is spaced from the distal end and is disposed substantially perpendicularly to the longitudinal axis to define a flow orifice. A secondary tube has a ballnose at a distal end thereof disposed in abutting contact with the sideseat for channeling fluid therebetween. A fastener joins together the strut and secondary tubes in compression between the ballnose and sideseat to maintain sealed contact therebetween for channeling fluid between the strut and secondary tubes.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
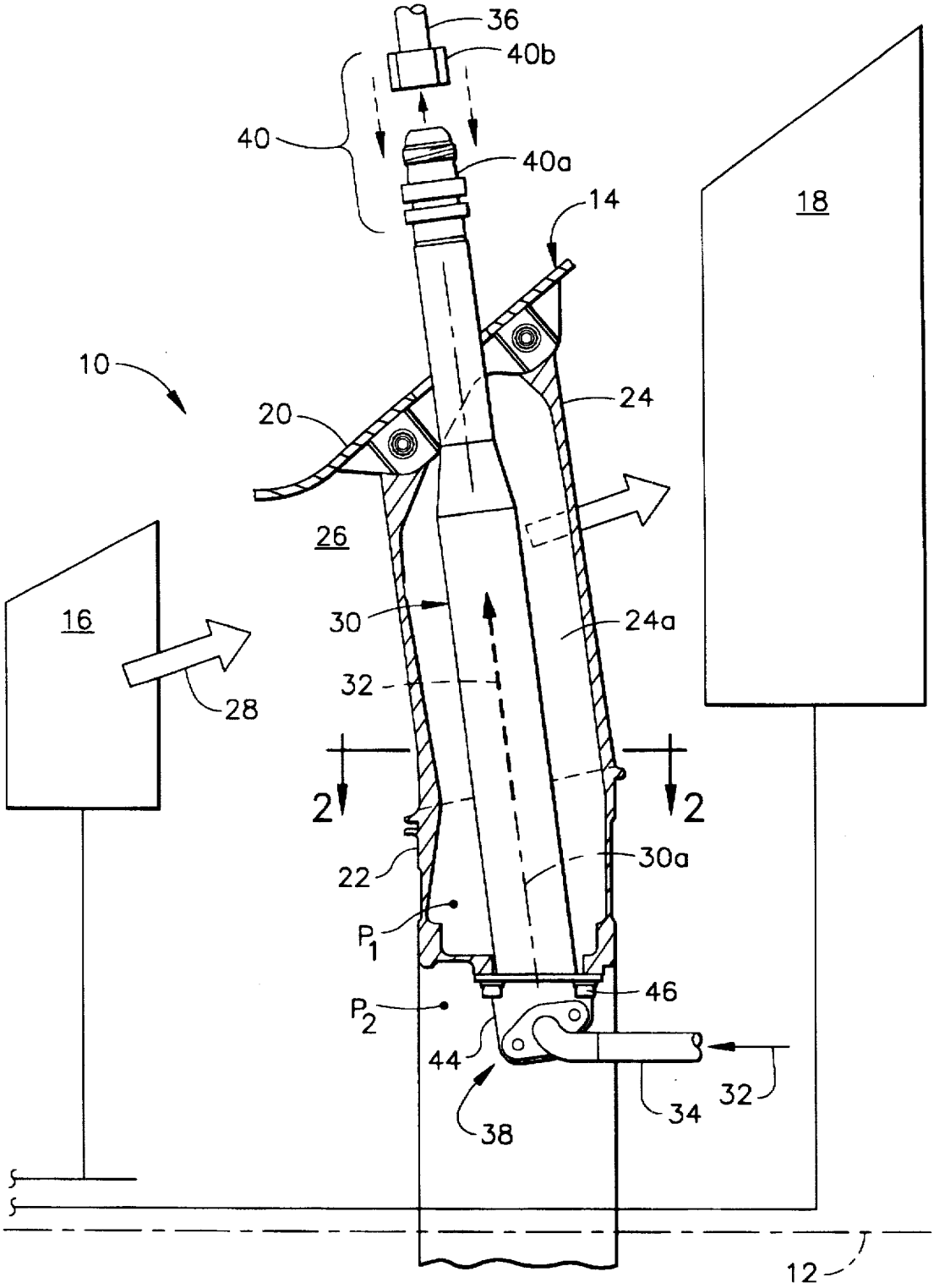
FIG. 1 is a schematic representation of a portion of an axisymmetric turbofan gas turbine engine illustrating an axial, partly sectional view of an annular turbine frame disposed between a pair of turbine rotors and having a radially inner low profile fluid joint in accordance with one embodiment of the present invention.

Illustrated in part schematically in FIG. 1 is a portion of an axisymmetrical gas turbine engine 10 having a longitudinal or axial centerline axis 12. In the exemplary embodiment illustrated, an annular turbine center frame 14 is coaxially disposed between corresponding rotors of a conventional high pressure turbine 16 and low pressure turbine 18. The turbines 16,18 include respective rows of rotor blades extending radially outwardly from rotor disks, with the respective disks being joined to concentric rotor shafts disposed coaxially about the centerline axis 12 all in a conventional configuration with the turbine frame 14.

The turbine frame 14 includes an annular outer casing 20, and an annular hub 22 disposed coaxially with the casing 20 about the centerline axis 12, and spaced radially inwardly therefrom. A plurality of circumferentially spaced apart, hollow struts 24 extend radially between the casing 20 and hub 22 and are conventionally fixedly joined thereto to define therebetween a flowpath 26 for channeling engine combustion gases 28 between the turbines 16, 18. The outer casing 20 is a stationary structural component which supports the rotating components of the engine. One or more of the turbine rotor shafts is supported from the hub 22 of the center frame 14 by a suitable bearing (not shown). The rotor and bearing loads are carried radially outwardly through the individual struts 24 and into the outer casing 20.

The struts 24 are hollow for reducing weight and for providing convenient passages between the outer casing 20 and the hub 22 radially inwardly through the flowpath 26 for channeling required service lines or conduits therebetween. Conventional sources of cooling air and lubrication oil are located outside the casing 20 of the frame 14, with bearings and other components requiring oil or pressurized air being located inside the engine within the hub region near the centerline axis 12. Typical service lines include oil supply, damper bearing supply, oil drain, scavenge, and sump pressurization or pressure balance system air supply. Accordingly, the required conduits or tubes therefor may be readily routed through individual ones of the struts 24 without further affecting the flowpath 26.

However, the flowpath 26 is a primary aerodynamic component of the engine which is specifically configured for maximizing aerodynamic engine efficiency. Since the struts 24 inherently obstruct a portion of the flowpath 26 between the turbine stages, aerodynamic losses are associated therewith. In order to reduce these losses, the individual struts 24 are limited in size both axially along their chord dimension as well as along their tangential or circumferential thickness dimension.

Figure 2:
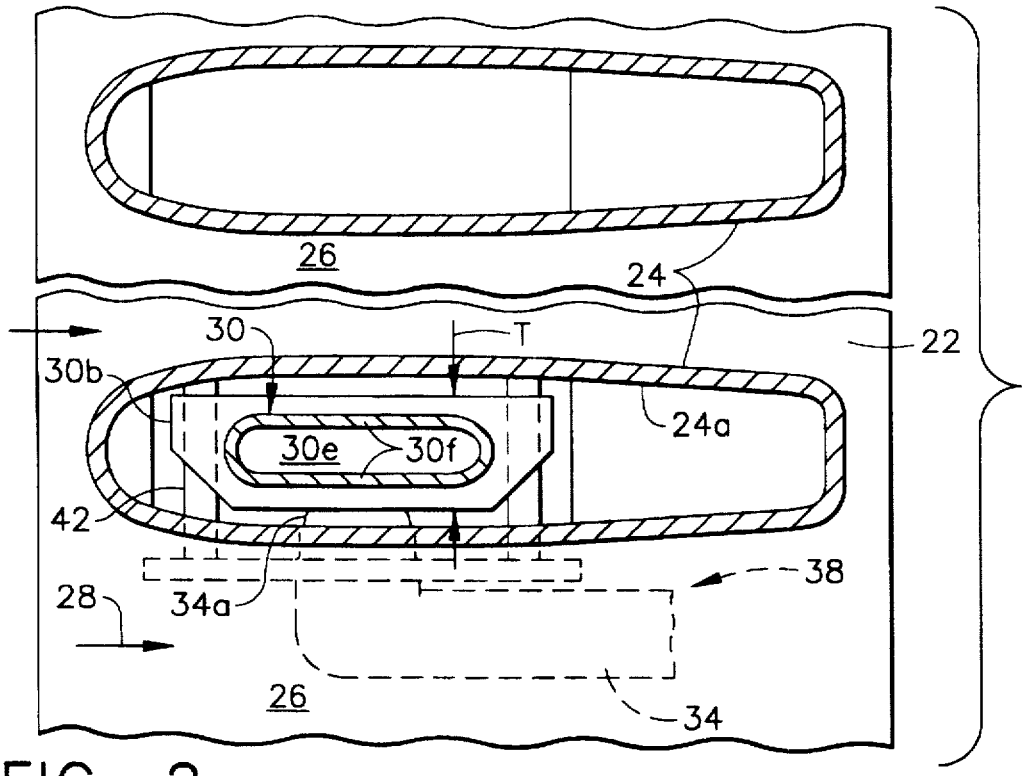
FIG. 2 is a circumferential sectional view through a portion of the turbine frame illustrated in FIG. 1 and taken generally along line 2—2 illustrating the low profile joint on a strut tube passing through one of the frame struts in accordance with an exemplary embodiment of the present invention.

As shown in FIG. 2, the struts 24 preferably have an aerodynamically thin and smooth outer profile or configuration which is flattened in the circumferential direction so that the struts 24 are substantially smaller in circumferential thickness than in axial chord length. In this way, flow blockage is minimized.

However, the conventional design of lubrication and secondary air systems in the engine require certain minimum internal passage size of the service lines for reducing pressure losses therein. Since the service lines extend through the struts 24, the conflicting design requirements thereof increase the design complexity of providing suitably sized and configured service lines through the narrow struts 24.

A portion of an exemplary service line is illustrated as extending through a first one of the struts 24 illustrated in FIG. 1. For ease of manufacture and assembly, as well as disassembly, the service line is preferably formed in components including a first or strut tube 30 which extends radially through the strut 24, and also through the outer casing 20 and hub 22. The strut tube 30 has a longitudinal axis 30*a* which extends generally in the radial direction. The strut tube 30 may have any suitable profile or outer configuration, but is typically flattened laterally in a generally rectangular or oval profile to fit within the complementary internal passage 24*a* of the strut 24 as illustrated in more particularity in FIG. 2.

The strut tube 30 is provided for any conventional use such as carrying therethrough either pressurized air or oil as required in the engine. In the exemplary embodiment illustrated in FIG. 1, the strut tube 30 forms a portion of a scavenge service line which carries scavenge oil 32 therethrough. The scavenge oil 32 is the return oil from one of the engine bearings.

The corresponding service line therefore also includes a radially inner secondary tube 34 below the hub 22 as illustrated in FIG. 1 which initially carries the scavenge oil 32 from the bearing to the strut tube 30. A radially outer secondary tube 36 is disposed outside the outer casing 20 and joins the strut tube 30 for continuing the service line in the lubrication system as conventionally known.

In order to allow assembly and disassembly of the service line through the strut 24, the inner and outer tubes 34,36 are sealingly joined to the common strut tube 30 using inner and outer fluid joints 38,40 which themselves are readily connected or disconnected using simple fasteners without the need for undesirable cutting at the joints. In the exemplary embodiment illustrated in FIG. 1, the outer joint 40 is in the form of a conventional B-nut joint having a ballnose fitting 40*a* suitably welded to the radially outer end of the strut tube 30, with a complementary seat and nut 40*b* suitably joined to the outer tube 36. The B-nut threadingly engages the ballnose fitting 40*a* to form a fluid tight compression joint which may be readily disconnected as desired.

Since the outer joint 40 is necessarily larger in size or diameter than the size of the strut tube 30 for maintaining uniform flowrate therethrough, it typically cannot be assembled upwardly through the relatively thin strut 24 without binding. In accordance with the present invention, the inner joint 38 has a low profile configuration which allows the cooperating portion of the strut 30 to be readily assembled radially inwardly through the narrow strut 24 without obstruction.

Figure 3:
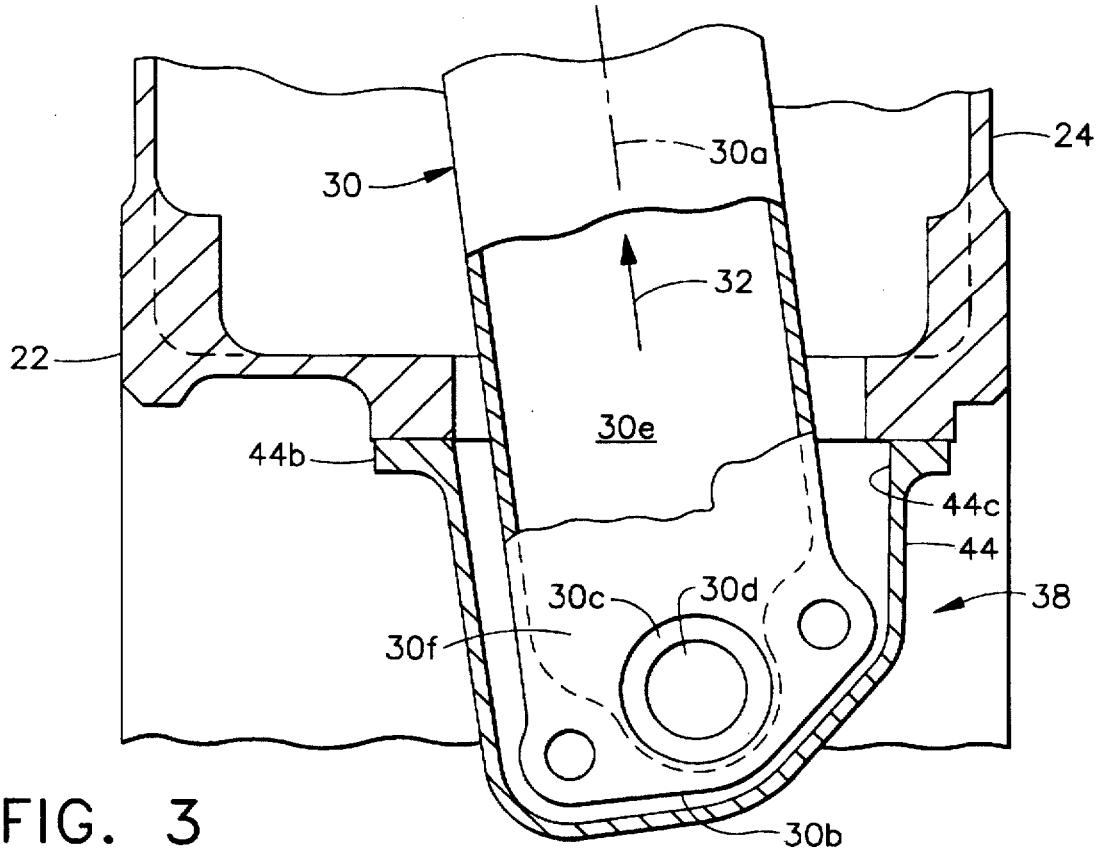
FIG. 3 is an enlarged, partly sectional view of the inner distal end of the strut tube illustrated in FIG. 1 showing a sideseat portion of the low profile fluid joint illustrated in FIG. 1.
Figure 4:
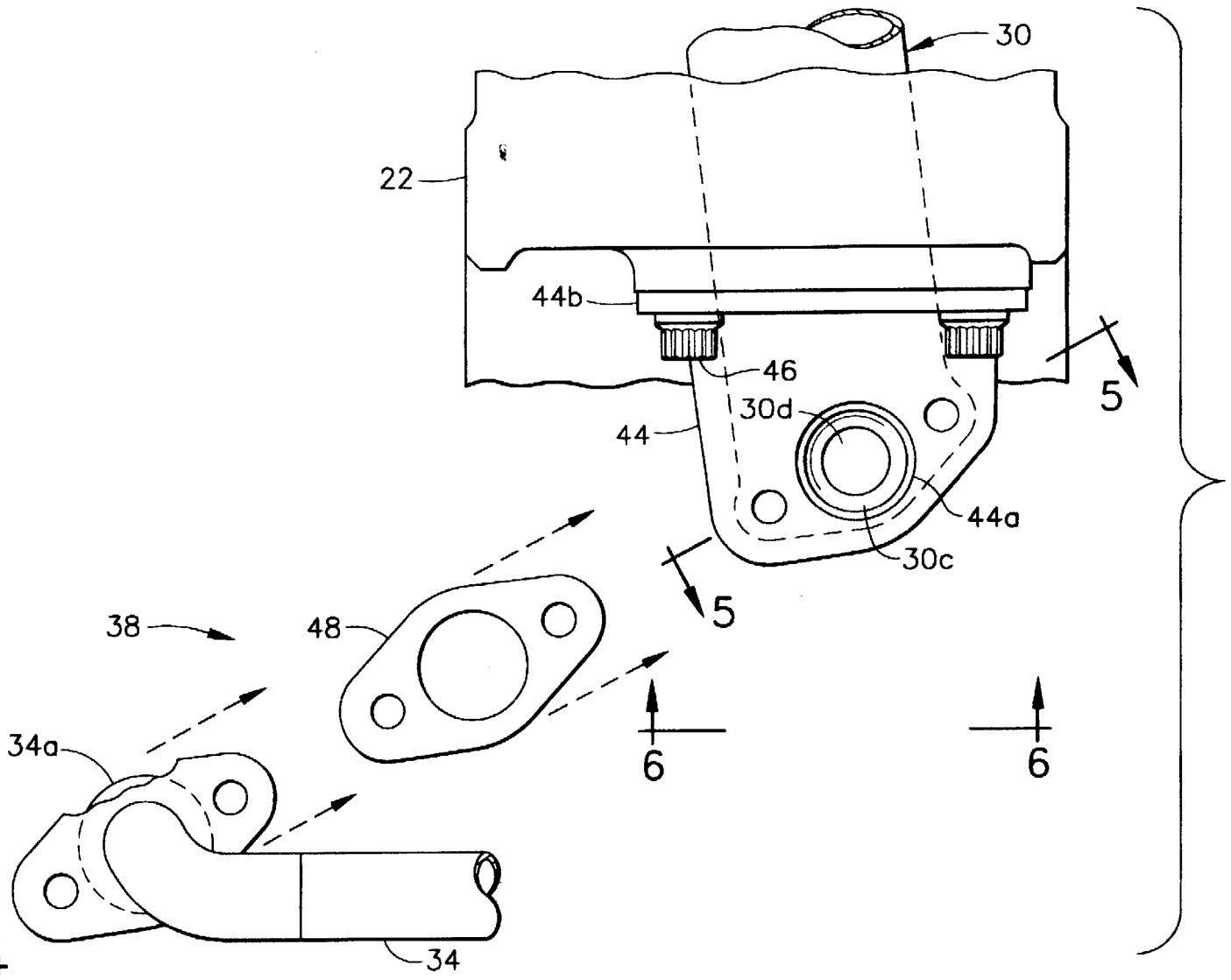
FIG. 4 is an exploded view of the low profile fluid joint illustrated in FIG. 1.

More specifically, the inner joint 38 is illustrated in more particularity in FIGS. 3 and 4 in accordance with a preferred embodiment of the present invention specifically configured for the inner end of the strut tube 30, although a similar joint could also be configured for the outer end of the strut tube 30 instead of the conventional outer joint 40. Unlike a conventional strut tube having a coaxial opening at a distal end thereof, like the outer end of the strut tube 30 illustrated in FIG. 1, the strut tube 30 illustrated in FIG. 3 has a closed radially inner distal end 30*b*, and annular sideseat 30*c* spaced radially outwardly from the distal end 30*b* and disposed substantially perpendicularly to the longitudinal axis 30*a* to define a flow orifice 30*d*. As illustrated in FIG. 2, the strut tube 30 has a generally flattened rectangular or oval outer profile at its distal end adjacent the sideseat 30*c*, and a complementary oval internal flow passage 30*e* defined between opposite, generally flat lateral sidewalls 30*f*. The sidewalls 30*f* are generally parallel to the longitudinal axis 30*a* and spaced oppositely in circumferential or tangential directions. The sideseat 30*c* is disposed in a selected first one of the sidewalls 30*f*.

The sideseat 30*c* illustrated in FIG. 3 is preferably circular in the form of a spherical concave annulus, with the diameter of the orifice 30*d* being suitably large to provide a flow area generally equal to the flow area of the strut tube passage 30*e* for allowing substantially uniform flowrate of fluid therethrough. In this way, the relatively large tube sidewall 30*f*, as opposed to its narrow closed distal end 30*b*, is effectively utilized for locating the sideseat 30*c* and orifice 30*d* without requiring a substantial increase in size of the tube inner end 30*b* which would otherwise be required for a conventional B-nut fluid joint connection.

The inner tube 34, illustrated for example in FIG. 4, correspondingly includes an annular ballnose 34*a* at a distal end thereof disposed in flow communication with the center passage thereof. The ballnose 34*a* is conventional in the form of a spherical convex annulus which is disposed in abutting, sealed contact with its complementary sideseat 30*c* for channeling fluid therethrough and between the strut tube 30 and the inner tube 34. The ballnose 34*a* engages the sideseat 30*c* substantially perpendicularly to the strut tube longitudinal axis 30*a*, therefore placing the inner joint 38 on the circumferential or tangential side of the strut tube 30 to effect the low profile feature of the joint which allows unobstructed assembly of the strut tube 30 radially inwardly through the narrow strut 24.

Various means may be used for joining together the strut tube 30 and the inner tube 34 in compression between the mating ballnose 34*a* and sideseat 30*c* to maintain sealed contact therebetween and for defining the disconnectable mechanical inner joint 38. For example, in the exemplary embodiment illustrated in FIGS. 1–5, a pair of fasteners 42, in the form of a bolt and nut assembly, are used for clamping together the ballnose 34*a* in its sideseat 30*c*.

Figure 5:
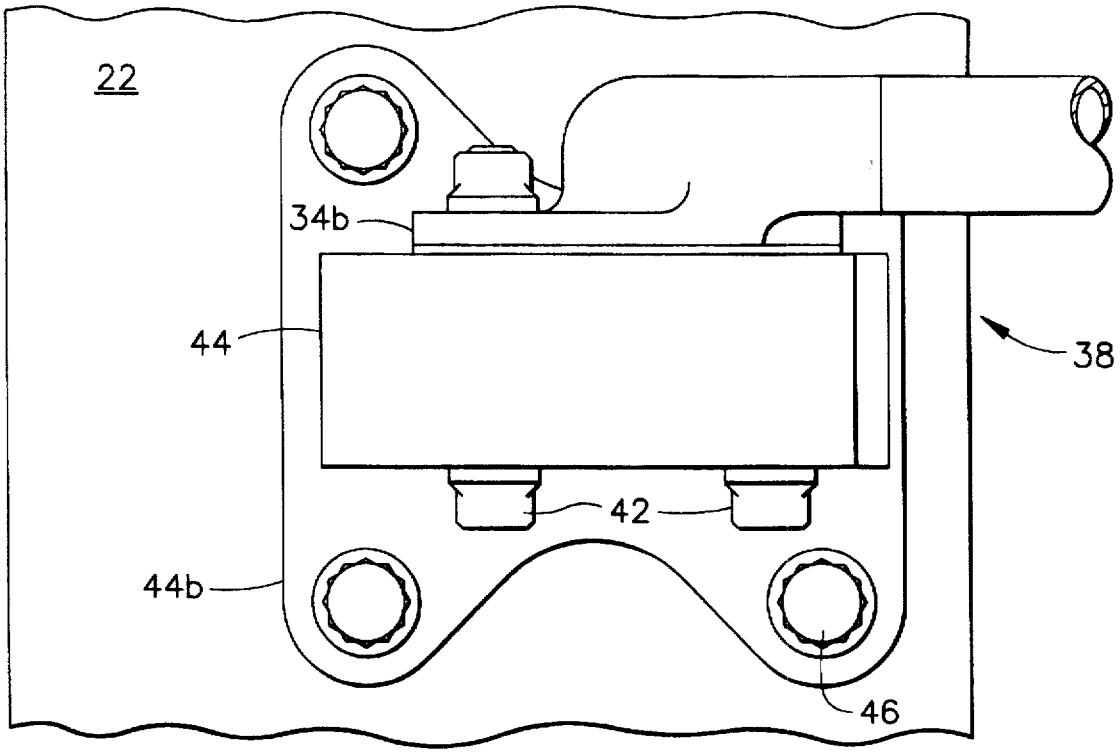
FIG. 5 is a sectional view through the low profile fluid joint illustrated in FIG. 4 and taken generally along line 5—5.
Figure 6:
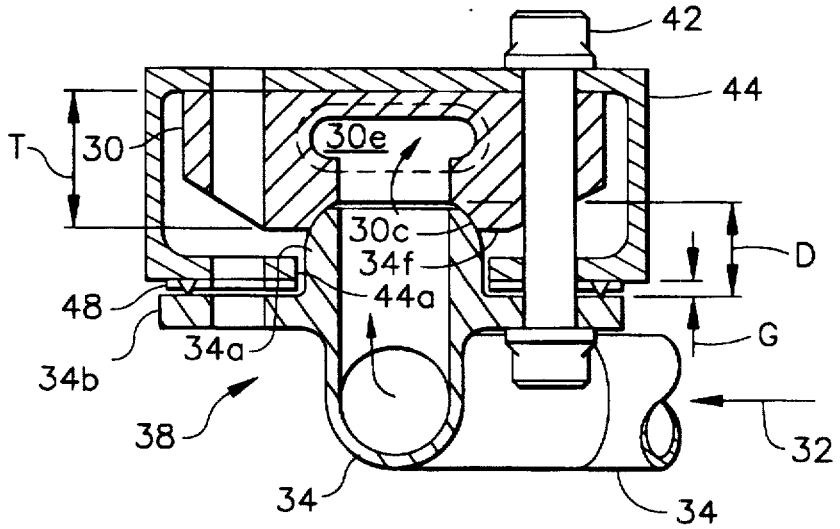
FIG. 6 is a plan view of the low profile fluid joint illustrated in FIG. 4 taken generally along line 6—6.

FIGS. 5 and 6 illustrate in more particularity this exemplary arrangement wherein the inner tube 34 further includes an integral joining flange 34*b* which surrounds the ballnose 34*a*, and is disposed substantially parallel to the strut tube sidewall 30*f*. The fasteners 42 extend through both the joining flange 34*b* and through the strut tube 30 itself through corresponding apertures thereof. Tightening of the fasteners 42 clamps together the ballnose 34*a* in the sideseat 30*c*, with the fasteners undergoing tension. As shown in FIG. 5, the fasteners 42 are preferably symmetrically disposed relative to the ballnose 34 for distributing the clamping loads on both sides of the ballnose 34*a*, which requires accurate tension of the individual fasteners 42 in equal amounts.

In the exemplary embodiment of the inner joint 38 illustrated in FIG. 1, it is desirable to both support the inner end of the strut 30 to the hub 22 and provide a secondary seal thereat. In conventional practice, cooling air is circulated inside the hub 22 under a first pressure $P_1$ which is different than a second pressure $P_2$ radially inwardly of the hub 22. Accordingly, the inner joint 38 preferably also includes a hollow cover or cap 44 which covers the distal end 30*b* of the strut tube 30, with the cap 44 having a sideport 44*a* coaxially aligned with the sideseat 30*c* for receiving the ballnose 34*a* therethrough as illustrated in FIGS. 4 and 5.

As shown in FIGS. 4 and 6, the cap 44 includes an integral mounting flange 44*b* which is configured to sealingly join to the frame hub 22 in any suitable manner. Suitable fasteners 46 such as threaded bolts extend through corresponding holes in the mounting flange 44b to clamp the cap 44 against the inner surface of the hub 22. The cap 44 includes an entry port 44c as illustrated in FIG. 3 which allows easy assembly of the cap 44 over the distal end of the strut tube 30. Except for the sideport 44a, entry port 44c, and holes for the fasteners 42, the cap 44 is otherwise imperforate to provide a chamber which is sealingly joined at the mounting flange 44b to the bottom of the hub 22 for maintaining the internal first pressure $P_1$ therein.

In the preferred embodiment illustrated in FIG. 5, the cap 44 includes through holes through which the fasteners 42 extend which allows the joining flange 34b to be additionally clamped against the cap 44 as well as the distal end of the strut tube 30. In this way, the cap 44 supports the inner end of the strut tube 30 to the frame hub 22 and provides a seal therefor.

Since the cap 44 illustrated in FIGS. 4 and 5 has a sideport 44a through which the ballnose 44a engages the sideseat 30c, additional means in the form of a conventional gasket 48 are provided for sealingly joining the ballnose 34a to the cap 44 at the sideport 44a for sealing fluid leakage therethrough. The gasket 48 is disposed in compression between the joining flange 34b and the cap 44 around the sideport 44a. The joining flange 34b is preferably attached to the ballnose 34a at a predetermined distance D from the engaging portion of the ballnose 34a in the sideseat 30c to define a corresponding predetermined gap G between the joining flange 34b and the side of the cap 44 in which is positioned the gasket 48.

In the exemplary embodiment illustrated in FIG. 5, the gasket 48 includes an integral projection rib which firstly engages the opposite surfaces of the joining flange 34b and the cap 44 which is initially compressed when the fasteners 42 are tightened. When the ballnose 34a is fully seated, compression of the gasket 48 is limited by the specified gap thickness G. This ensures that the gasket 48 is neither over compressed, nor has portions which fail to compress which would provide undesirable leakage sites thereat.

The exemplary embodiment of the inner joint 38 provides substantial improvement over conventional joints such as the B-nut joint. By side mounting the sideseat 30c on one of the sidewalls of the strut tube 30, the inner joint 38 can achieve a maximum flow area in the orifice 30d for providing acceptable flow connection to the oval internal passage 30e of the strut tube 30. The cross section of the tube distal end 30b is only slightly larger than the nominal profile of the strut tube itself as required for accommodating the compression loads of the ballnose 34a in the sideseat 30c, and for accommodating the apertures for the fasteners 42.

The strut tube 30 may therefore be initially assembled radially inwardly through the frame strut 24 of limited dimensions while providing a tube flow area similar to that normally obtained by using a welded-in-place tube with oversized end connections. In a comparable conventional design, relatively large B-nut fittings would be joined to both outer and inner ends of the strut tube, with the former having a fitting welded to the strut tube outer end after the strut tube is inserted upwardly through the strut, and the latter being pre-welded. The invention eliminates these requirements.

Disassembly of the inner joint 38 is readily accomplished by removing the fasteners and the cap 44, which allows the strut tube 30 to be removed radially upwardly through the frame strut 24 without obstruction. Compared to the conventional B-nut design described above, no cutting is required to separate or remove any fitting. However, the proven sealing advantages of ballnose-seat fluid joints is retained in the inner joint 38 for effective sealing operation without the undesirably large space requirement of the conventional B-nut joint.

As illustrated in FIGS. 2 and 5, the strut tube 30 has a maximum thickness T at its inner distal end which is preferably sized to fit inside the strut 24 upon complete insertion therethrough between opposite radial ends thereof. The thickness T of the strut tube 30 may be maximized within the available space of the oval strut 24 while still providing a low profile fluid joint, the strut portion of which may be readily assembled by inserting the strut tube 30 radially inwardly completely through the corresponding strut 24. The distal end of the strut tube 30 including the sideseat 30c may therefore be preformed or preassembled with the strut tube 30 before assembly into the turbine frame 14.

The strut tube 30 may be conventionally formed with relatively thin sheet metal walls, with the distal ends thereof being separately manufactured as individual castings initially welded to the ends of the strut tubes 30. The so preformed strut tube 30 may then be readily inserted through a corresponding strut 24, with the fluid joint at the inner and outer tubes 34, 36 being readily made by engaging the cooperating joint fittings. Post-assembly of the joint fittings to the strut tube 30 using welding is not required, and, corresponding cutting of fittings is not required for disassembly and removal of the strut tube 30 from the frame 14 during a service operation.

Figure 7:
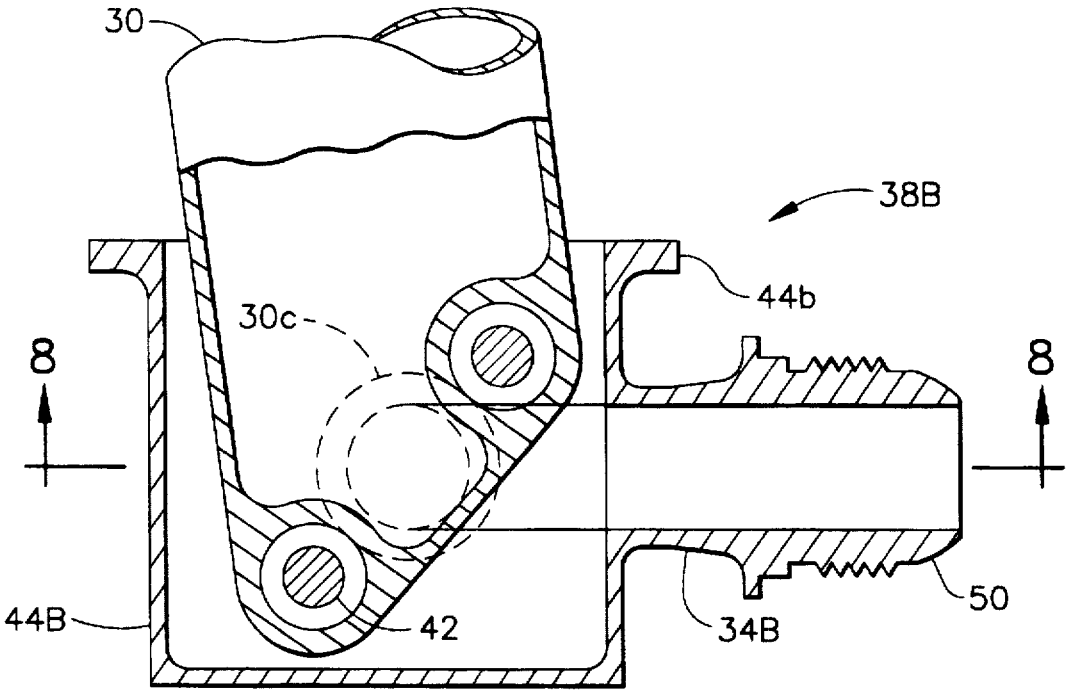
FIG. 7 is a partly sectional view of a low profile fluid joint in accordance with a second embodiment of the present invention configured for the inner end of the strut tube illustrated in FIG. 1.
Figure 8:
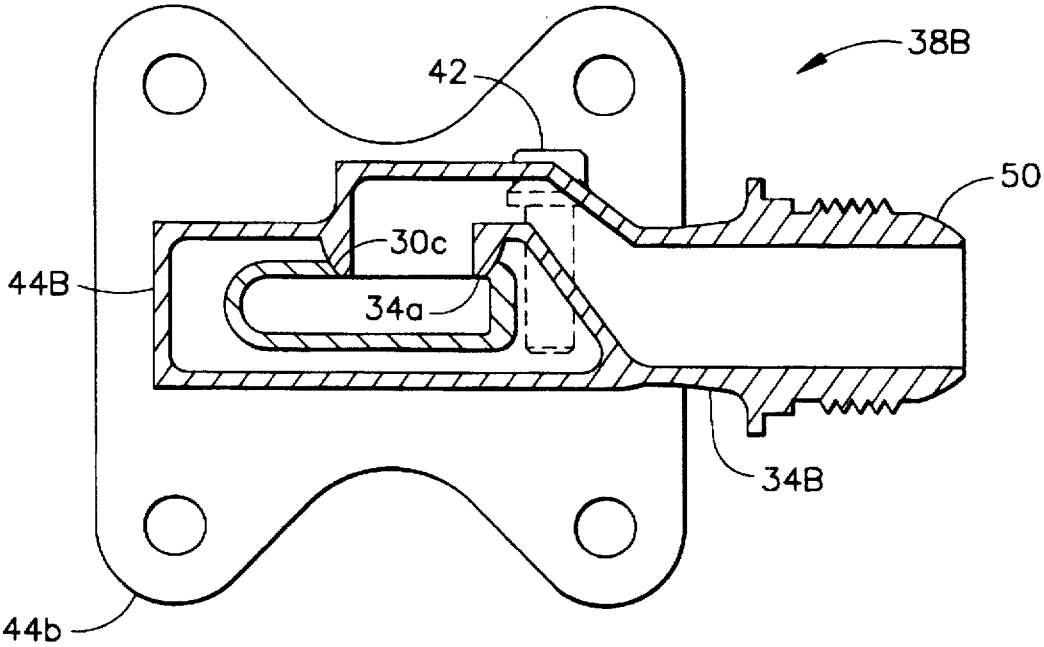
FIG. 8 is a partly sectional view of the fluid joint illustrated in FIG. 7 and taken generally along line 8—8.

Illustrated in FIGS. 7 and 8 is a second embodiment of the inner joint designated 38B wherein the inner tube 34B and cap 44B comprise an integral, one-piece assembly. In this embodiment, the inner tube 34B includes an integral threaded ballnose 50 which mates with a complementary seat (not shown) of a conventional B-nut connection providing yet another disconnectable joint from proven assembly and disassembly.

In the second embodiment illustrated in FIGS. 7 and 8, the need for the sideport 44a of the first embodiment illustrated in FIG. 5 and the gasket 48 is eliminated, by instead integrally forming the ballnose 34a in FIG. 8 directly with a sidewall of the cap 44B. Inherent sealing is therefore provided, with the mounting flange 44b being similarly joined to the hub 22, and with the fasteners 42 extending laterally through the cap 44B and threaded into the distal end of the strut tube 30 for compressing the ballnose 34a in its sideseat 30c.

Figure 9:
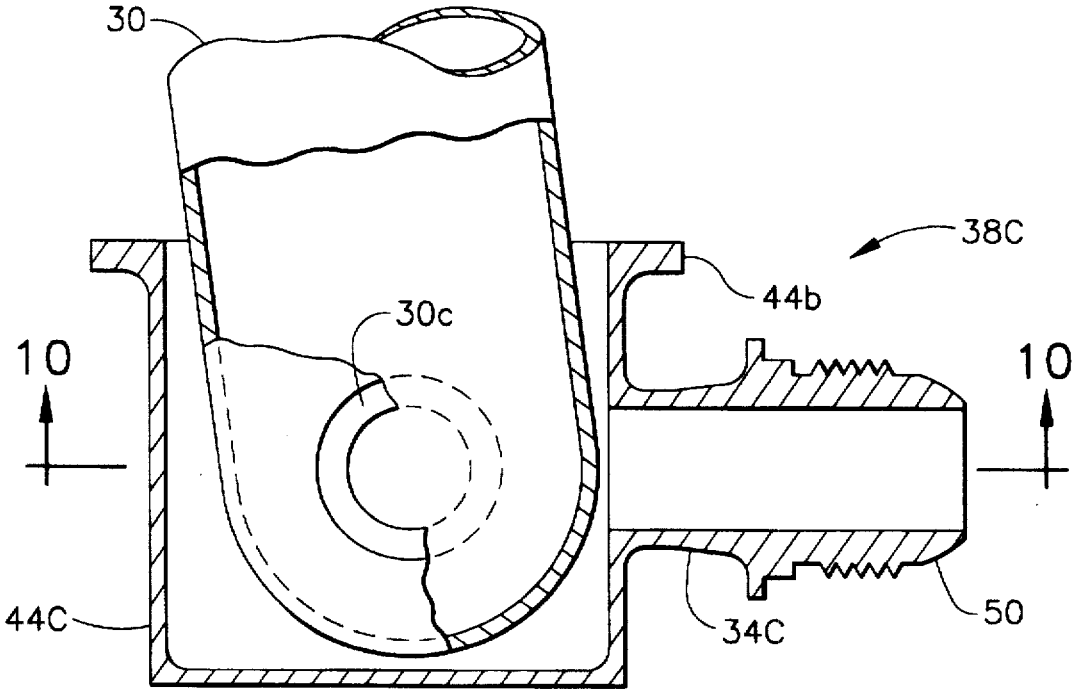
FIG. 9 is a partly sectional view of a low profile fluid joint in accordance with a third embodiment of the present invention configured for the inner end of the strut tube illustrated in FIG. 1.
Figure 10:
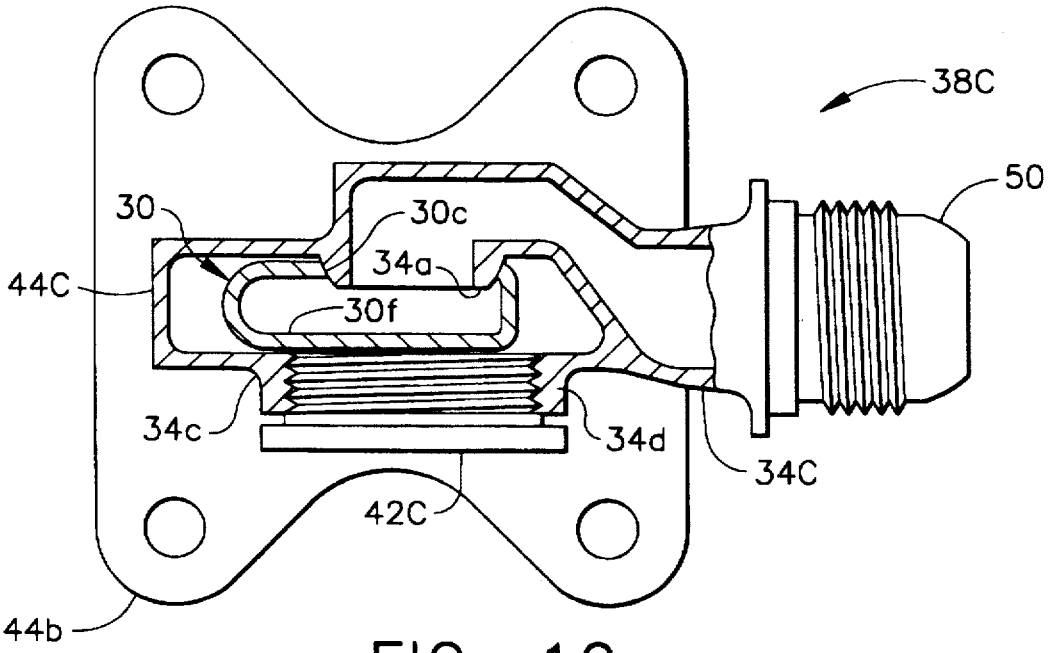
FIG. 10 is a partly sectional view of the fluid joint illustrated in FIG. 9 and taken generally along line 10—10.

Illustrated in FIGS. 9 and 10 is a third embodiment of the inner joint designated 38C, wherein the inner tube 34C is again integral with the cap 44C like that illustrated in FIGS. 7 and 8, with a different form of fastener for engaging the ballnose 34a in its sideseat 30c. In this embodiment, no fastening holes are required through the inner distal end of the strut tube 30 or the cap 44C itself. Instead, the inner tube 34C illustrated in FIG. 10 includes a differently configured integral joining flange 34c which is spaced laterally in part from the ballnose 34a adjacent the back sidewall 30f of the strut tube 30, with the joining flange 34c also forming a portion of the sidewall of the cap 44C.

The joining flange 34c includes an integral threaded collar 34d coaxially aligned with the ballnose 34a. A single fastener in the form of a threaded plug 42C extends through the joining flange 34c in threaded engagement with the collar 34d and is tightened in compression against the back sidewall 30f for clamping together the ballnose 34a and the sideseat 30c.

The single plug fastener 42C has a relatively large diameter coaxially aligned with the ballnose 34a for providing more uniform clamping around the perimeter of the sideseat 30*c* for improving sealing performance. The opening afforded by the collar 34*d* also facilitates machining of the ballnose internal to the cap 44C.

The first and second embodiments disclosed above utilize a pair of fasteners 42 for engaging the ballnose in its sideseat. Completion of the inner joints therefore requires careful attention to the uniform application of clamping force from both fasteners 42. However, in the embodiment illustrated in FIGS. 9 and 10, more uniform application of the clamping force is readily obtained by simply tightening the single plug fastener 42C. This design more closely follows the conventional B-nut sealing joint wherein the nut thereof ensures uniform application of the clamping loads.

FIGS. 11–15 illustrate yet another, fourth embodiment of the invention which more fully provides the benefit of a conventional B-nut joint without the undesirable higher profile thereof. The fourth embodiment illustrated in these Figures is specifically configured for providing a low profile outer joint designated 40D for the radially outer end of the strut 30 illustrated in FIG. 1 for showing an additional application of the invention.

Figure 11:
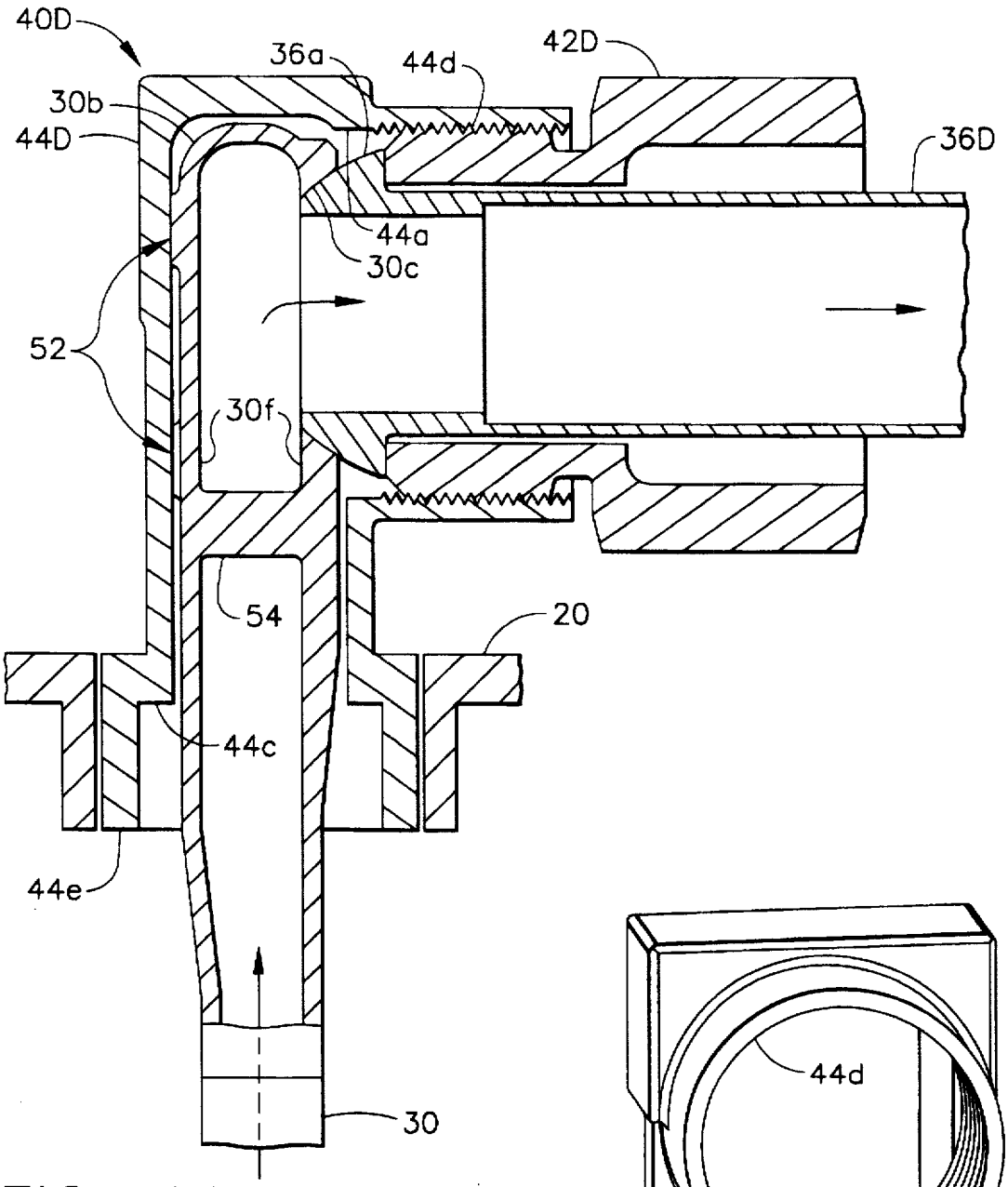
FIG. 11 is a sectional view of a low profile fluid joint in accordance with a fourth embodiment of the present invention configured for the outer end of the strut tube illustrated in FIG. 1.

In this embodiment as illustrated in FIG. 11, the distal end 30*b* of the strut tube 30 is a radially outer end with the cooperating features similarly numbered such as the sideseat 30*c* and sidewalls 30*f*. The radially outer secondary tube is designated 36D, and suitably integrally includes at one end a ballnose designated 36*a* which is substantially identical to the ballnose 34*a* described above with respect to the inner joints.

Figure 12:
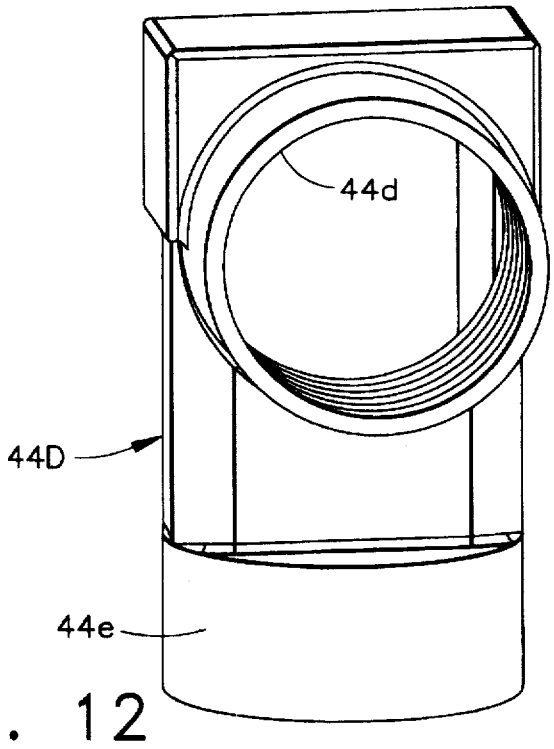
FIG. 12 is an isometric view of an exemplary cap for surrounding the distal end of the strut tube illustrated in FIG. 11.

The cap or cover 44D, shown also in FIG. 12, includes an integral, internally threaded collar 44*d* surrounding the sideport 44*a* and disposed coaxially therewith. In this embodiment, the fastener is in the form of an inverse nut 42D coaxially surrounding the outer tube 36D. The fastener 42D includes an externally threaded portion which engages the collar 34*d*, and an integral nut portion which is turned by any suitable tool. When the nut is rotated, the threaded portion thereof engages the collar 44*d* to compress the ballnose 36*a* into its mating sideseat 30*c*.

This embodiment of the outer joint 40D more closely enjoys the proven sealing capability of a conventional B-nut joint, but in the improved low profile design of the invention. The fastener 42D coaxially applies force to the back side of the ballnose 36*a* to ensure uniform seating and compression in the complementary sideseat 30*c*. The threads of the fastener 42D also effectively seal the sideport 44*a* of the cap 44D. The opposite end of the cap 44D includes another cylindrical collar 44*e* which may be integrally formed around the entry port 44*c* for engaging a cooperating aperture through the outer casing 20 for providing a suitably sealed joint thereat, with or without additional gaskets or O-rings therebetween.

In order to yet further improve uniformity of seating between the ballnose 36*a* and the sideseat 30*c*, the back sidewall 30*f* of the strut tube 30 as illustrated in FIG. 11 preferably includes three elevated bumps or stops 52 which engage in abutment the back wall of the cap 44D. Alternatively, the stops 52 may be provided on the back wall of the cap 44D instead of on the back wall of the strut tube 30.

Figure 15:
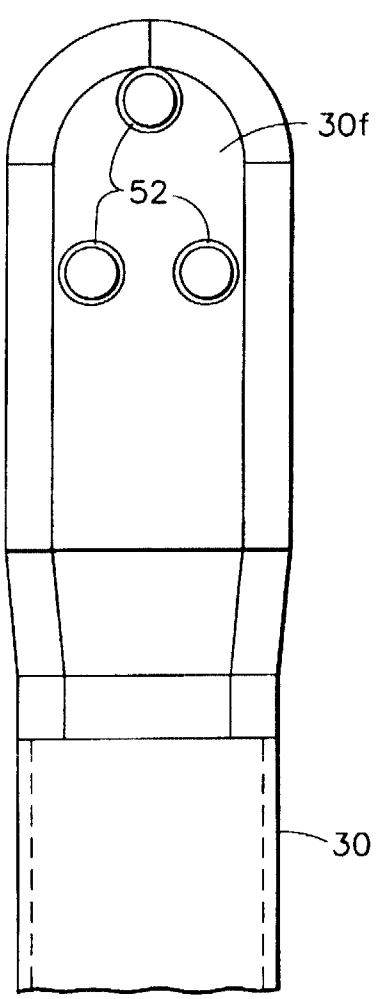
FIG. 15 is a back elevation view of the strut tube illustrated in FIG. 13 and taken generally along line 15—15.
Figure 14:
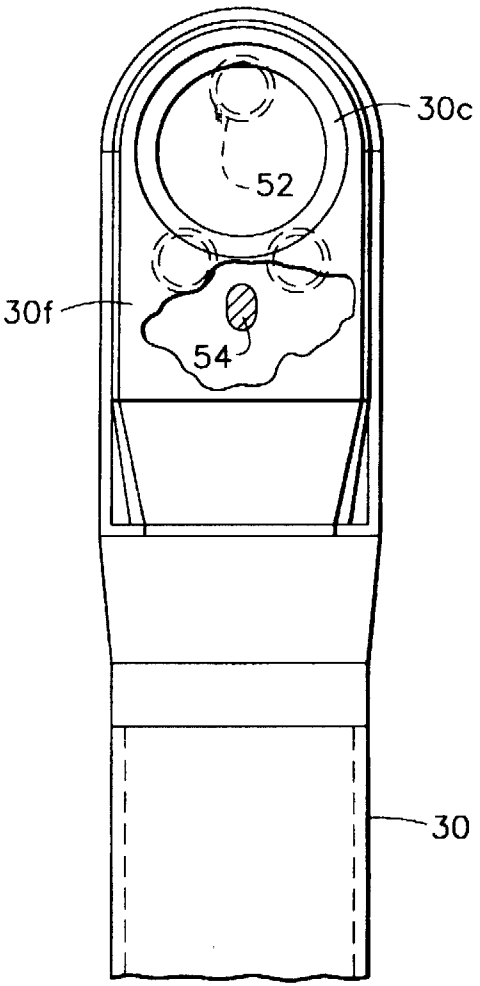
FIG. 14 is a front elevation view of the strut tube illustrated in FIG. 13 and taken generally along line 14—14.
Figure 13:
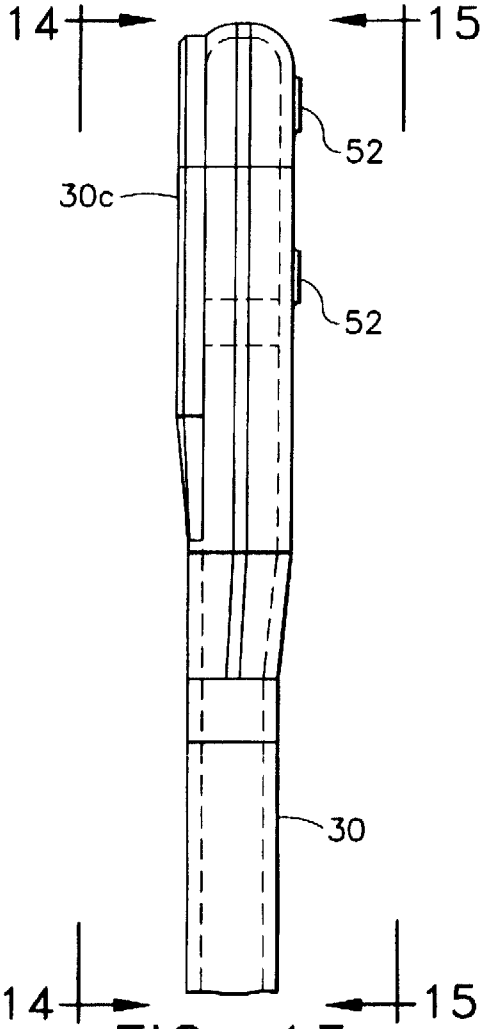
FIG. 13 is a side elevation view of the distal end of the strut tube illustrated in FIG. 11.

FIGS. 13–15 illustrate side, front, and back views of the outer end of the strut tube 30 having the sideseat 30*c* therein. Preferably only three stops 52 are used and are arranged in a generally isosceles triangle in alignment with the sideseat 30*c* and cooperating ballnose 36*a* for more evenly distributing compression loads circumferentially therearound. Analysis predicts generally uniform compression contact force between the ballnose 36*a* and the cooperating sideseat 30*c* using the three stops 52 which define the reaction loadpath into the cap 44D.

As the fastener 42D, as illustrated in FIG. 11, is tightened, compression loads are carried through the ballnose 36*a* circumferentially around the sideseat 30*c* and laterally through the outer end of the strut tube 30 to the back sidewall 30*f*. The loads then pass through the individual stops 52 into the cap 44D. The sideseat 30*c* is inherently rigidly supported around most of its perimeter by the endwalls of the strut tube 30. Since the strut tube 30 is hollow, a reinforcing rib 54 as illustrated in FIGS. 11 and 14 is preferably provided between the opposing sidewalls 30*f* for carrying a portion of the compression loads therethrough. In this way, the entire sideseat 30*c* is more uniformly supported around its perimeter within the strut tube 30 for ensuring effective sealing abutment between the ballnose 36*a* and its sideseat 30*c*.

The various embodiments of the low profile fluid joints disclosed above may be specifically sized and configured for either the radially inner or outer ends of the strut tube 30, or both if desired in turbine or compressor frames. The improved joints utilize proven B-nut joint design with cooperating ballnoses and complementary seats for providing effective fluid seals which may be readily assembled or disassembled using threaded fasteners of various forms. The low profile joints are simple to implement, and eliminate the substantially larger fittings which would otherwise be used in a conventional B-nut joint, while enjoying the proven sealing capability of B-nut joints. The low profile fluid joint effectively utilize the relatively large area provided by the sidewalls 30*f* of the oval strut tubes 30 for providing a full-flow joint in the limited nominal configuration of the strut tube 30 itself.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A gas turbine engine frame comprising:

an outer casing;

a hub disposed coaxially with said casing and spaced radially inwardly therefrom;

a plurality of circumferentially spaced apart, hollow struts extending radially between said casing and hub and defining therebetween a flowpath for channeling engine gases;

an elongate strut tube having a longitudinal axis, and extending radially through a first one of said struts;

said strut tube having a closed distal end, and an annular sideseat spaced radially from said distal end and disposed substantially perpendicularly to said longitudinal axis to define a flow orifice;

a secondary tube having a ballnose at a distal end thereof disposed in abutting contact with said sideseat for channeling fluid therethrough; and a fastener joining together said strut and secondary tubes in compression between said ballnose and sideseat to maintain sealed contact therebetween and defining a fluid joint for channeling said fluid between said strut and secondary tubes.

2. A frame according to claim 1 wherein said strut tube has a generally oval profile adjacent said sideseat, and a complementary internal flow passage defined between opposite lateral sidewalls, and said sideseat is disposed in a first one of said sidewalls.

3. A frame according to claim 2 wherein:

said secondary tube includes a joining flange surrounding said ballnose disposed substantially parallel to said first sidewall; and said fastener extends through both said joining flange and said strut tube in tension for clamping together said ballnose and sideseat.

4. A frame according to claim 2 wherein:

said secondary tube includes a joining flange spaced from said ballnose adjacent said second sidewall of said strut tube; and said fastener extends through said joining flange in compression against said second sidewall for clamping together said ballnose and sideseat.

5. A frame according to claim 2 further comprising a hollow cap covering said distal end of said strut tube, and having a sideport aligned with said sideseat for receiving said ballnose therethrough.

6. A frame according to claim 5 further comprising means for sealingly joining said ballnose to said cap at said sideport for sealing leakage therethrough.

7. A frame according to claim 6 wherein:

said cap includes a mounting flange sealingly joined to said frame hub;

said joining means include a joining flange surrounding said ballnose, and a gasket disposed in compression between said joining flange and said cap around said sideport; and said joining flange is attached to said ballnose at a predetermined distance from said sideseat to limit compression of said gasket.

8. A frame according to claim 5 wherein said secondary tube and cap comprise an integral assembly.

9. A frame according to claim 5 wherein:

said cap further includes an integral threaded collar surrounding said sideport; and said fastener comprises a threaded nut surrounding said secondary tube, and engaging said collar to compress said ballnose into said sideseat.

10. A frame according to claim 9 further comprising three stops disposed between said second sidewall of said strut tube and said cap, and aligned with said sideseat and ballnose for more evenly distributing compression loads circumferentially therearound.

11. A frame according to claim 2 wherein said strut tube has a maximum thickness at said distal end sized to fit inside said strut upon complete insertion therethrough between opposite radial ends thereof.

12. A low profile fluid joint comprising:

an elongate strut tube having a longitudinal axis, and a closed distal end, and an annular sideseat spaced from said distal end and disposed substantially perpendicularly to said longitudinal axis to define a flow orifice;

a secondary tube having a ballnose at a distal end thereof disposed in abutting contact with said sideseat for channelling fluid therethrough; and a fastener joining together said strut and secondary tubes in compression between said ballnose and sideseat to maintain sealed contact therebetween for channeling said fluid between said strut and secondary tubes.

* * * * *